US006516299B1

(12) United States Patent
Case

(10) Patent No.: US 6,516,299 B1
(45) **Date of Patent: *Feb. 4, 2003**

(54) METHOD, SYSTEM AND PRODUCT FOR MODIFYING THE DYNAMIC RANGE OF ENCODED AUDIO SIGNALS

(75) Inventor: Eliot M. Case, Denver, CO (US)

(73) Assignee: Qwest Communication International, Inc., Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 56 days.

(21) Appl. No.: 08/771,462

(22) Filed: Dec. 20, 1996

(51) Int. Cl.[7] ..... G10L 21/00
(52) U.S. Cl. ..... 704/500; 704/200.1
(58) Field of Search ..... 704/208, 278, 704/233, 500, 501, 503, 504, 200.1, 201; 381/62, 119, 118

(56) References Cited

U.S. PATENT DOCUMENTS

| | | | |
|---|---|---|---|
| 4,061,875 | A | 12/1977 | Freifeld et al. |
| 4,099,035 | A | 7/1978 | Yanick |
| 4,118,604 | A | 10/1978 | Yanick |
| 4,156,116 | A | 5/1979 | Yanick |
| 4,509,186 | A | 4/1985 | Omura et al. |
| 4,536,886 | A | 8/1985 | Papamichalis et al. |
| 4,703,480 | A | 10/1987 | Westall et al. |
| 4,813,076 | A | 3/1989 | Miller |
| 4,820,059 | A | 4/1989 | Miller et al. |
| 4,969,192 | A | 11/1990 | Chen et al. |
| 4,975,958 | A | 12/1990 | Hanada et al. |
| 5,033,090 | A | 7/1991 | Weinrich |

(List continued on next page.)

FOREIGN PATENT DOCUMENTS

| | | |
|---|---|---|
| EP | 0446037 A2 | 9/1991 |
| EP | 0446037 A3 | 9/1991 |
| EP | 0607989 A2 | 7/1994 |
| EP | 0607989 A3 | 7/1994 |
| WO | WO94/25959 | 11/1994 |

OTHER PUBLICATIONS

Broadhead et al Direst Manipulation of MPEG Compressed Digital Audio, ACM Mutimedia 95, Nov. 9, 1995.*
New Digital Hearing Aids Perk Up Investors' Ears, St. Louis Psot–Dispatch Sep. 27, 1995.
Jean–Pierre Renard, Ph.D., B.B.A., High Fidelity Audio Coding, pp. 87–97.

*Primary Examiner*—Richemond Dorvil
*Assistant Examiner*—Angela A. Armstrong
(74) *Attorney, Agent, or Firm*—Brooks & Kushman, P.C.

(57) ABSTRACT

A method, system and product for modifying the dynamic range of an encoded audio signal. The method includes receiving the encoded audio signal, the encoded audio signal having a first set of scale factors associated with a first dynamic range, and identifying a playback destination for the encoded audio signal, the playback destination having a second dynamic range. The method also includes mapping the first set of scale factors to a second set of scale factors associated with the second dynamic range, and replacing the first set of scale factors in the encoded audio signal with the second set of scale factors to create a modified encoded audio signal for decoding and reassembly at the playback destination. The system includes control logic for performing the method. The product includes a storage medium having computer readable programmed instructions for performing the method.

12 Claims, 2 Drawing Sheets

U.S. PATENT DOCUMENTS 5,040,217 A 8/1991 Brandenburg et al.
5,140,638 A 8/1992 Moulsley et al.
5,199,076 A 3/1993 Taniguchi et al.
5,201,006 A 4/1993 Weinrich
5,226,085 A 7/1993 Di Francesco
5,227,788 A 7/1993 Johnston et al.
5,233,660 A 8/1993 Chen
5,235,669 A 8/1993 Ordentlich et al.
5,255,343 A 10/1993 Su
5,285,498 A 2/1994 Johnston
5,293,449 A 3/1994 Tzeng
5,293,633 A 3/1994 Robbins
5,301,019 A 4/1994 Citta
5,301,205 A 4/1994 Tsutsui et al.
5,329,613 A 7/1994 Brase et al.
5,341,457 A 8/1994 Hall, II et al.
5,353,375 A 10/1994 Goto et al.
5,404,377 A 4/1995 Moses
5,440,596 A * 8/1995 Kneepkens et al. ..... 375/240
5,467,139 A 11/1995 Lankford
5,473,631 A 12/1995 Moses
5,485,524 A * 1/1996 Kuusama et al. ..... 381/94.3
5,488,665 A 1/1996 Johnston et al.
5,500,673 A 3/1996 Zhou
5,509,017 A 4/1996 Brandenburg et al.
5,511,093 A 4/1996 Elder et al.
5,512,939 A 4/1996 Zhou
5,515,395 A 5/1996 Tsutsui
5,524,060 A * 6/1996 Silfvest et al. ..... 381/104
5,633,981 A * 5/1997 Davis ..... 704/230
5,832,444 A * 11/1998 Schmidt ..... 704/500
5,907,622 A * 5/1999 Dougherty ..... 381/57
6,041,295 A * 3/2000 Hinderks ..... 704/206

* cited by examiner

METHOD, SYSTEM AND PRODUCT FOR MODIFYING THE DYNAMIC RANGE OF ENCODED AUDIO SIGNALS

CROSS-REFERENCE TO RELATED APPLICATIONS

This application is related to U.S. patent application Ser. No. 08/771,790 entitled "Method, System And Product For Lossless Encoding Of Digital Audio Data"; Ser. No. 08/771,792 entitled "Method, System And Product For Modifying Transmission And Playback Of Encoded Audio Data"; Ser. No. 08/771,512 entitled "Method, System And Product For Harmonic Enhancement Of Encoded Audio Signals"; Ser. No. 08/769,911 entitled "Method, System And Product For Multiband Compression Of Encoded Audio Signals"; Ser. No. 08/777,724 entitled "Method, System And Product For Mixing Of Encoded Audio Signals"; Ser. No. 08/769,732 entitled "Method, System And Product For Using Encoded Audio Signals In A Speech Recognition System"; Ser. No. 08/772,591 entitled "Method, System And Product For Synthesizing Sound Using Encoded Audio Signals"; Ser. No. 08/769,731 entitled "Method, System And Product For Concatenation Of Sound And Voice Files Using Encoded Audio Data"; and Ser. No. 08/771,469 entitled "Graphic Interface System And Product For Editing Encoded Audio Data", all of which were filed on the same date and assigned to the same assignee as the present application.

TECHNICAL FIELD

This invention relates to a method, system and product for modifying the dynamic range of encoded audio signals for compatibility with the dynamic range of a selected playback destination.

BACKGROUND ART

To more efficiently transmit digital audio data on low bandwidth data networks, or to store larger amounts of digital audio data in a small data space, various data compression or encoding systems and techniques have been developed. Many such encoded audio systems use as a main element in data reduction the concept of not transmitting, or otherwise not storing portions of the audio that might not be perceived by an end user. As a result, such systems are referred to as perceptually encoded or "lossy" audio systems.

However, as a result of such data elimination, perceptually encoded audio systems are not considered "audiophile" quality, and suffer from processing limitations. To overcome such deficiencies, a method, system and product have been developed to encode digital audio signals in a loss-less fashion, which is more properly referred to as "component audio" rather than perceptual encoding, since all portions or components of the digital audio signal are retained. Such a method, system, and product are described in detail in U.S. patent application Ser. No. 08/771,790 entitled "Method, System And Product For Lossless Encoding Of Digital Audio Data", which was filed on the same date and assigned to the same assignee as the present application, and is hereby incorporated by reference.

Significantly, the dynamic range associated with either perceptually encoded audio or component audio is fairly large. In that regard, the dynamic range of most perceptually encoded audio systems is in the 120 dB range, quantized in 2 dB steps. The dynamic range of component audio systems may be as large as 256 dB, quantized in 1 dB steps.

Unfortunately, however, the dynamic ranges associated with many playback destinations where perceptually encoded audio or component audio are decoded and reassembled are often much smaller than the dynamic range of the encoded audio signal. Still further, no industry standards exist for audio levels in perceptually encoded audio. With the 120 dB dynamic range previously described, audio levels are "all over the place."

Thus, there exists a need for a method, system and product for modifying the dynamic range of audio signals encoded according to presently deployed perceptually encoded audio systems or component audio systems for compatibility with the dynamic range of a selected playback destination. Such a method, system and product would provide more consistent audio levels for a particular application without compromising the original source material, while using presently deployed encoded audio systems. In this fashion, such a method, system and product would make dialog, music, and sound effects in a movie, for instance, much more consistent so that a viewer need not repeatedly adjust volume control, and would also ensure that the dialog does not fall below the noise floor of a cable TV system.

SUMMARY OF THE INVENTION

Accordingly, it is the principle object of the present invention to provide a method, system and product for modifying the dynamic range of encoded audio signals for compatibility with the dynamic range of a selected playback destination.

According to the present invention, then, a method is provided for modifying a dynamic range of an encoded audio signal. The method comprises receiving the encoded audio signal, the encoded audio signal having a first set of scale factors associated with a first dynamic range, and identifying a playback destination for the encoded audio signal, the playback destination having a second dynamic range. The method further comprises mapping the first set of scale factors to a second set of scale factors associated with the second dynamic range, and replacing the first set of scale factors in the encoded audio signal with the second set of scale factors to create a modified encoded audio signal for decoding and reassembly at the playback destination.

A system for modifying a dynamic range of an encoded audio signal is also provided. The system comprises a receiver for receiving the encoded audio signal, the encoded audio signal having a first set of scale factors associated with a first dynamic range-, and means for identifying a playback destination for the encoded audio signal, the playback destination having a second dynamic range. The system further comprises control logic operative to map the first set of scale factors to a second set of scale factors associated with the second dynamic range, and replace the first set of scale factors in the encoded audio signal with the second set of scale factors to create a modified encoded audio signal for decoding and reassembly at the playback destination.

A product for modifying a dynamic range of an encoded audio signal is also provided. The product comprises a storage medium having computer readable programmed instructions recorded thereon. The instructions are operative to map a first set of scale factors associated with a first dynamic range of an encoded audio signal to a second set of scale factors associated with a second dynamic range of a playback destination, and replace the first set of scale factors in the encoded audio signal with the second set of scale factors to create a modified encoded audio signal for decoding and reassembly at the playback destination.

These and other objects, features and advantages will be readily apparent upon consideration of the following detailed description in conjunction with the accompanying drawings.

BEST MODE FOR CARRYING OUT THE INVENTION

Figure 1:
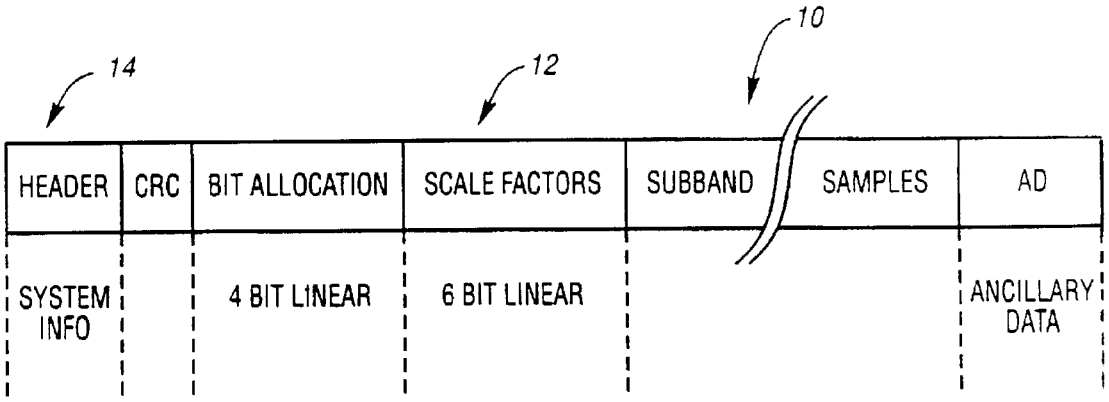
Fig. 1 (PRIOR ART)
FIG. 1 is an exemplary encoding format for an audio frame according to prior art perceptually encoded audio systems.

Referring now to FIGS. 1–4, the preferred embodiment of the present invention will now be described. FIG. 1 depicts an exemplary encoding format for an audio frame according to prior art perceptually encoded audio systems, such as the various levels of the Motion Pictures Expert Group (MPEG), Musicam, or others. Examples of such systems are described in detail in a paper by K. Brandenburg et al. entitled "ISO-MPEG-1 Audio: A Generic Standard For Coding High-Quality Digital Audio", Audio Engineering Society, 92nd Convention, Vienna, Austria, March 1992, which is hereby incorporated by reference.

In that regard, it should be noted that the present invention can be applied to subband data encoded as either time versus amplitude (low bit resolution audio bands as in MPEG audio layers 1 or 2, and Musicam) or as frequency elements representing frequency, phase and amplitude data (resulting from Fourier transforms or inverse modified discrete cosine spectral analysis as in MPEG audio layer 3, Dolby AC3 and similar means of spectral analysis). It should further be noted that the present invention is suitable for use with any system using mono, stereo or multichannel sound including Dolby AC3, 5.1 and 7.1 channel systems.

As seen in FIG. 1, such perceptually encoded digital audio includes multiple frequency subband data samples (10), as well as 6 bit dynamic scale factors (12) (per subband) representing an available dynamic range of approximately 120 decibels (dB) given a resolution of 2 dB per scale factor. The bandwidth of each subband is ⅓ octave. Such perceptually encoded digital audio still further includes a header (14) having information pertaining to sync words and other system information such as data formats, audio frame sample rate, channels, etc.

To greatly increase the available dynamic range and/or the resolution thereof, one or more bits may be added to the dynamic scale factors (12) For example, by using 8 bit dynamic scale factors, the dynamic range is doubled to 256 dB and given an improved 1 dB per scale factor resolution. Alternatively, such 8 bit dynamic scale factors, with a given resolution of 0.5 dB per scale factor, will provide a dynamic range of 128 dB. In either case, the accuracy of storage is increased or maintained well beyond what is needed for dynamic range, while the side-effects of low resolution dynamic scaling are reduced.

As will be described in greater detail below, regardless of the dynamic range of the encoded audio (e.g., perceptual audio encoding, or component audio encoding), the present invention is provided for modifying the scale factors (12) associated with that dynamic range. In such a fashion, the present invention makes the encoded audio signals compatible with the dynamic range of the playback destination, without compromising the original source material.

Figure 2:
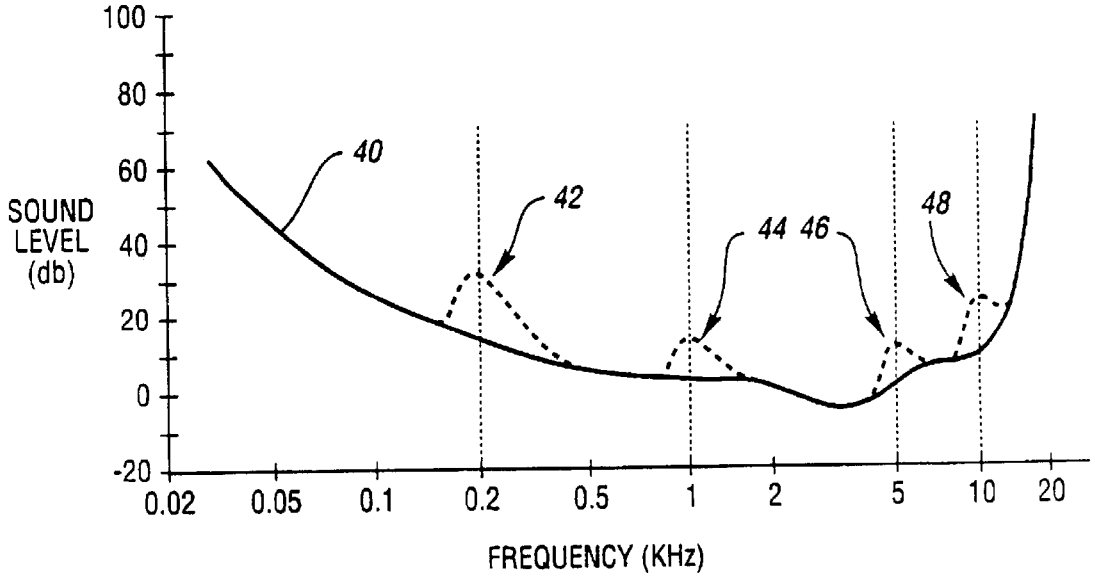
Fig. 2 (PRIOR ART)
FIG. 2 is a psychoacoustic model of a human ear including exemplary masking effects for use with the present invention.

As previously discussed, perceptually encoded audio systems eliminate portions of the audio that might not be perceived by an end user. This is accomplished using well known psychoacoustic modeling of the human ear. Referring now to FIG. 2, such a psychoacoustic model including exemplary masking effects is shown. As seen therein, at a given frequency (in kHz), sound levels (in dB) below the base line curve (40) are inaudible. Using this information, prior art perceptually encoded audio systems eliminate data samples in those frequency subbands where the sound level is likely inaudible.

As also seen therein, short band noise centered at various frequencies (42, 44, 46, 48) modifies the base line curve (40) to create what are known as masking effects. That is, such noise (42, 44, 46, 48) raises the level of sound required around such frequencies before that sound will be audible to the human ear. Using this information, prior art perceptually encoded audio systems further eliminate data samples in those frequency subbands where the sound level is likely inaudible due to such masking effects.

Alternatively, using a loss-less component audio encoding scheme, such masked audio may be retained. Once again, such a loss-less component audio encoding scheme is described in detail in U.S. patent application Ser. No. 08/771,790 entitled "Method, System And Product For Lossless Encoding Of Digital Audio Data", which was filed on the same date and assigned to the same assignee as the present application, and has been incorporated herein by reference.

In either case, if no information is present to be encoded into a subband, the subband does not need to be transmitted. Moreover, if the subband data is well below the level of audibility (not including masking effects), as shown by base line curve (40) of FIG. 2, the particular subband need not be encoded.

Figure 3:
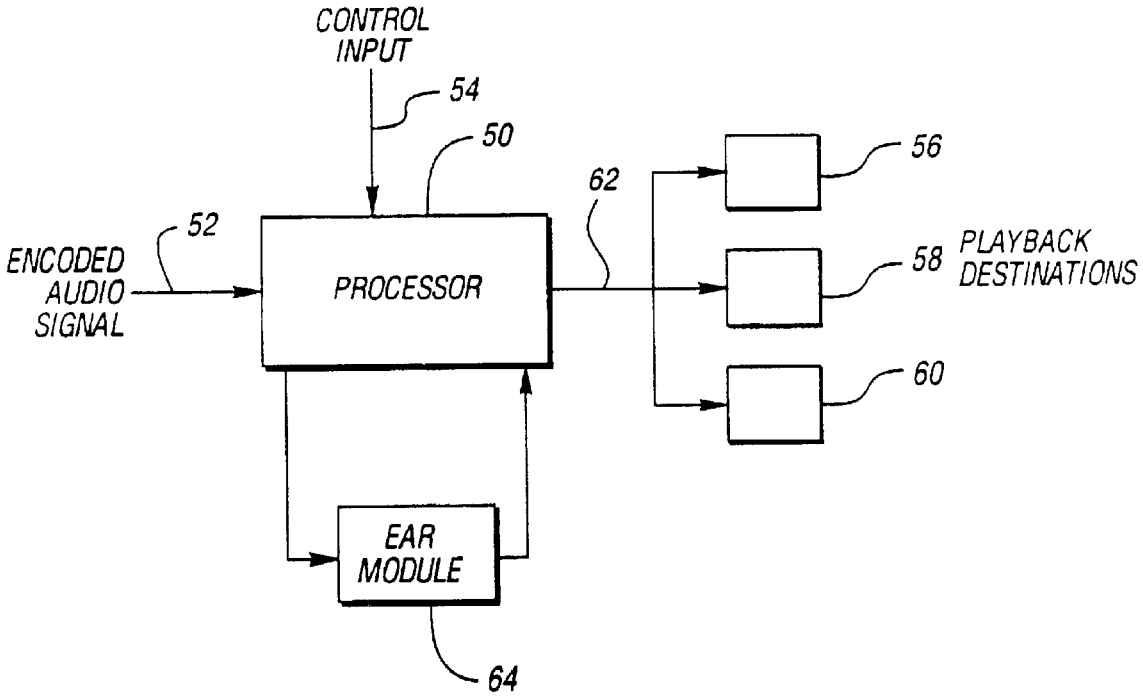
FIG. 3 is a simplified block diagram of the system of the present invention.

Referring now to FIG. 3, a simplified block diagram of the system of the present invention is shown. As seen therein, the system preferably comprises an appropriately programmed processor (50) for Digital Signal Processing (DSP). Processor (50) acts as a receiver for receiving an encoded audio signal (52) having a first set of scale factors associated with a first dynamic range. As previously described, encoded audio signal (52) may be either a perceptually encoded audio signal or a component audio signal.

Once programmed, processor (50) provides control logic for performing various functions of the present invention. In that regard, processor (50) also receives control input (54) for identifying any one of a plurality of particular destinations (56, 58, 60) where the encoded audio signal (52) will be decoded and reassembled for playback. Destinations (56, 58, 60) each have their own dynamic ranges which differ from the dynamic range of the encoded audio signal (50). As previously described, the dynamic range of a destination (56, 58, 60) is typically smaller than that of the encoded audio signal (52), although it could be larger.

Still referring to FIG. 3, the control logic of processor (50) is operative to map the first set of scale factors associated with the dynamic range of the encoded audio signal (52) to a second set of scale factors associated with the dynamic range of the particular destination (56, 58, 60) identified for playback via control input (54). The control logic of processor (50) is further operative to replace the first set of scale factors in the encoded audio signal (52) with the second set of scale factors in order to create a modified encoded audio signal (62).

For example, if the dynamic range of the encoded audio signal (52) is 100 db and the dynamic range of a particular playback destination (56, 58, 60) is 50 dB, the present invention will map the set of scale factors of the encoded audio signal (52) associated with the 100 dB dynamic range to a set of scale factors associated with the 50 dB dynamic range of the particular playback destination (56, 58, 60). In such a fashion, 100 dB audio levels in the encoded audio signal (52) may be played back at 100 dB at the destination (56, 58, 60), 50 dB audio levels in the encoded audio signal (52) may be played back at 75 dB, and audio levels just over 0 dB in the encoded audio signal (52) may be played back at 50 dB.

As is readily apparent, modified encoded audio signal (62) is similar to encoded audio signal (52), with the exception of the scale factors. That is, if encoded audio signal (52) is a perceptual audio signal, then so is modified encoded audio signal (62). Similarly, if encoded audio signal (52) is a component audio signal, then so is modified encoded audio signal (62). In such a fashion, encoded audio signal (52) has been scaled appropriately for the dynamic range of the particular destination (56, 58, 60) identified. Processor (50) then transmits modified encoded audio signal (62) to the destination (56, 58, 60) identified for decoding, reassembly, and playback thereat.

The system of the present invention may further comprise an ear model (64), which is provided in communication with processor (50). Ear model (64) provides a psychoacoustic model similar to that previously described with reference to FIG. 2. In that regard, processor (50) uses ear model (64) in mapping the first set of scale factors associated with the dynamic range of encoded audio signal (52) to the second set of scale factors associated with the dynamic range of the particular destination (56, 58, 60) identified for playback. More particularly, processor (50) uses ear model (64) to scale the modified encoded audio signal (62) to the characteristics of the human ear, which is more sensitive to frequencies around 3–4 kHz. This helps maintain a more "human" interpretation of consistent audio levels, such that louder low frequency sounds do not overpower softer mid-frequency sounds to which the human ear is more sensitive. In such a fashion, a common problem with prior art compression schemes may be overcome.

Figure 4:
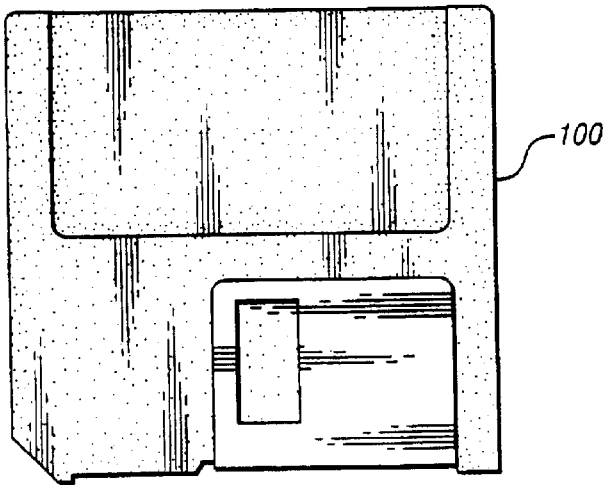
FIG. 4 is an exemplary storage medium for use with the product of the present invention.

Referring finally to FIG. 4, an exemplary storage medium for the product of the present invention is shown. In that regard, storage medium (100) is depicted as a conventional floppy disk, although any other type of storage medium may also be used.

Storage medium (100) has recorded thereon computer readable programmed instructions for performing various functions of the present invention. More particularly, storage medium (100) includes instructions operative to map a first set of scale factors associated with a first dynamic range of an encoded audio signal to a second set of scale factors associated with a second dynamic range of a playback destination, and replace the first set of scale factors in the encoded audio signal with the second set of scale factors to create a modified encoded audio signal for decoding and reassembly at the playback destination.

As previously discussed, the encoded audio signal may comprise a perceptually encoded audio signal or a component audio signal. Still further, the mapping of the first set of scale factors to the second set of scale factors may be dependent upon a psychoacoustic model.

By intercepting and modifying the information containing level in an encoded audio data stream, various program material can be controlled to maintain consistent levels on differing mediums, such as cable TV systems with limited dynamic range. In such a fashion, the present invention keeps dialog audible inside of a TV show, and also keep inserted commercials at a matching level.

It should be noted that this invention acts in real-time on a passing encoded audio data stream at the distribution level (at the point of transmission or the point of delivery), rather than as part of the final decoder that reassembles the signals back to a normal linear audio signal. In such a fashion, the original program material can remain at a wide dynamic range and uncompromised. Moreover, by modifying the dynamic range of the encoded audio before decoding, the calculations required are very simple (e.g., 32 per fame of audio). In contrast, standard tools for such modification after decoding are very intensive.

Thus, the present invention provides standardized audio levels for an application, thereby making dialog in movies broadcast on a cable TV system, for instance, much more consistent so that a viewer need not repeatedly adjust volume control. Still further, the dialog will not fall below the noise floor of the cable TV system.

By not compromising the original program material, dynamic range consistency of program material can be automated (for broadcasters). Moreover, if MPEG or other perceptual decoders are in place at the consumer level, then a very nice control can be "handed" to the user to allow consistency of audio levels. As a result, a user need not increase volume when the audio dips below an audible level, only to be forced to decrease volume when the next audio level comes in too loud.

If used in digital radio receivers in noisy environments such as automobiles, the present invention can control the dynamic range of music such that the most subtle elements thereof are closer to the same level as the loudest elements thereof. Moreover, inserted commercials will have a similar volume level, rather than coming in too loud. In that same regard, it should be noted that the present invention is suitable for use in any type of DSP application including audio/video post-production, computer systems, hearing aids, transmission across networks including cellular, wireless and cable telephony, internet, cable television, satellites, post-production, etc.

It should still further be noted that the present invention can be used in conjunction with the inventions disclosed in U.S. patent application Ser. No. 08/771,790 entitled "Method, System And Product For Lossless Encoding Of Digital Audio Data"; Ser. No. 08/771,792 entitled "Method, System And Product For Modifying Transmission And Playback Of Encoded Audio Data"; Ser. No. 08/771,512 entitled "Method, System And Product For Harmonic Enhancement Of Encoded Audio Signals"; Ser. No. 08/769,911 entitled "Method, System And Product For Multiband Compression Of Encoded Audio Signals"; Ser. No. 08/777,724 entitled "Method, System And Product For Mixing Of Encoded Audio Signals"; Ser. No. 08/769,732 entitled "Method, System And Product For Using Encoded Audio Signals In A Speech Recognition System"; Ser. No. 08/772,591 entitled "Method, System And Product For Synthesizing Sound Using Encoded Audio Signals"; Ser. No. 08/769,731 entitled "Method, System And Product For Concatenation Of Sound And Voice Files Using Encoded Audio Data"; and See. No.

08/771,469 entitled "Graphic Interface System And Product For Editing Encoded Audio Data", all of which were filed on the same date and assigned to the same assignee as the present application, and which are hereby incorporated by reference.

As is readily apparent from the foregoing description, then, the present invention provides a method, system and product for modifying the dynamic range of encoded audio signals for compatibility with the dynamic range of a selected playback destination. More particularly, the present invention provides more consistent audio levels for a particular application without compromising the original source material, while using presently deployed encoded audio systems.

It is to be understood that the present invention has been described above in an illustrative manner and that the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described herein.

What is claimed is:

1. A method for modifying a dynamic range of a subband encoded audio signal having a plurality of frequency subbands and a plurality of scale factors, the method comprising:

receiving the subband encoded audio signal, wherein the plurality of scale factors of the subband encoded audio signal are associated with a first dynamic range;

identifying one of a plurality of playback destinations, the playback destination identified having a second dynamic range;

mapping the plurality of scale factors of the subband encoded audio signal to a plurality of scale factors associated with the second dynamic range;

replacing the plurality of scale factors of the subband encoded audio signal with the plurality of scale factors associated with the second dynamic range to create a modified subband encoded audio signal for decoding and reassembly by a decoder at the playback destination identified.

2. The method of claim 1 wherein the subband encoded audio signal comprises an audio signal encoded according to a subband encoding technique designed for transmission purposes.

3. The method of claim 1 wherein the first dynamic range is greater than the second dynamic range.

4. The method of claim 3 wherein the first dynamic range is a wide dynamic range greater than 100 dB, and the second dynamic range is a narrow dynamic range less than 40 dB.

5. A system for modifying a dynamic range of a subband encoded audio signal having a plurality of frequency subbands and a plurality of scale factors, the system comprising:

a receiver for receiving the subband encoded audio signal, wherein the plurality of scale factors of the subband encoded audio signal are associated with a first dynamic range; and control logic operative to identify one of a plurality of playback destinations, the playback destination identified having a second dynamic range, map the plurality of scale factors of the subband encoded audio signal to a plurality of scale factors associated with the second dynamic range of the playback destination, and replace the plurality of scale factors of the subband encoded audio signal with the plurality of scale factors associated with the second dynamic range to create a modified subband encoded audio signal for decoding and reassembly by a decoder at the playback destination identified.

6. The system of claim 5 wherein the subband encoded audio signal comprises an audio signal encoded according to a subband encoding technique designed for transmission purposes.

7. The system of claim 5 wherein the first dynamic range is greater than the second dynamic range.

8. The system of claim 7 wherein the first dynamic range is a wide dynamic range greater than 100 dB, and the second dynamic range is a narrow dynamic range less than 40 dB.

9. A product for modifying a dynamic range of a subband encoded audio signal having a plurality of frequency subbands and a plurality of scale factors, the plurality of scale factors associated with a first dynamic range, the product comprising:

a storage medium; and computer readable instructions recorded on the storage medium, the instructions operative to identify one of a plurality of playback destinations, the playback destination identified having a second dynamic range, map the plurality of scale factors of the subband encoded audio signal to a plurality of scale factors associated with the second dynamic range of the playback destination, and replace the plurality of scale factors of the subband encoded audio signal with the plurality of scale factors associated with the second dynamic range to create a modified subband encoded audio signal for decoding and reassembly by a decoder at the playback destination identified.

10. The product of claim 9 wherein the subband encoded audio signal comprises an audio signal encoded according to a subband encoding technique designed for transmission purposes.

11. The product of claim 9 wherein the first dynamic range is greater than the second dynamic range.

12. The product of claim 11 wherein the first dynamic range is a wide dynamic range greater than 100 dB, and the second dynamic range is a narrow dynamic range less than 40 dB.

* * * * *